US008464510B2

(12) United States Patent
Haska et al.

(10) Patent No.: US 8,464,510 B2
(45) Date of Patent: Jun. 18, 2013

(54) AIR-JET SPINNING APPARATUS

(75) Inventors: Petr Haska, Ceska Trebova (CZ); Robert Mikyska, Dolni Dobrouc (CZ); Christian Griesshammer, Winterthur (CH)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 13/383,930

(22) PCT Filed: Jul. 9, 2010

(86) PCT No.: PCT/CH2010/000178

§ 371 (c)(1),
(2), (4) Date: Jan. 13, 2012

(87) PCT Pub. No.: WO2011/006270

PCT Pub. Date: Jan. 20, 2011

(65) Prior Publication Data

US 2012/0110973 A1 May 10, 2012

(30) Foreign Application Priority Data

Jul. 16, 2009 (CH) ..... 1115/09

(51) Int. Cl.
*D01H 4/02* (2006.01)

(52) U.S. Cl.
USPC ..... 57/403; 57/350

(58) Field of Classification Search
USPC ..... 57/315, 333, 350, 403
See application file for complete search history.

(56) References Cited

U.S. PATENT DOCUMENTS

| | | | | |
|---|---|---|---|---|
| 6,789,382 | B2 * | 9/2004 | Stalder et al. | 57/333 |
| 2003/0101710 | A1 * | 6/2003 | Wust et al. | 57/328 |
| 2003/0115850 | A1 * | 6/2003 | Stalder et al. | 57/333 |
| 2008/0072562 | A1 * | 3/2008 | Wust et al. | 57/333 |
| 2010/0043380 | A1 * | 2/2010 | Artzt et al. | 57/75 |

FOREIGN PATENT DOCUMENTS

EP 2 009 150 A1 12/2008

* cited by examiner

*Primary Examiner* — Shaun R Hurley
(74) *Attorney, Agent, or Firm* — Dority & Manning, P.A.

(57) ABSTRACT

An air spinning device has a nozzle body and a hollow spindle with a spindle tip and a longitudinal axis, wherein the spindle tip protrudes into the nozzle body. An outlet channel having a ring-shaped cross-sectional area is formed between an outside surface of the spindle tip and an inside surface of the nozzle body. The gap width at a certain location of the outlet channel normal to the longitudinal axis of the spindle is constant over the circumference of the spindle. The outside surface of the spindle tip and/or the inside surface of the nozzle body is/are shaped in such a way that at least two constrictions are formed in the outlet channel in its course in the direction of the longitudinal axis of the spindle, wherein the outlet channel has a ring-shaped cross-sectional area at each of these constrictions smaller than the ring-shaped cross-sectional area of the outlet channel upstream and downstream from each of these constrictions.

15 Claims, 4 Drawing Sheets

AIR-JET SPINNING APPARATUS

FIELD OF THE INVENTION

The invention relates to an air spinning device, and more particularly to an air spinning device having a nozzle body and a hollow spindle with a spindle tip and a longitudinal axis, wherein the spindle tip protrudes into the nozzle body and an outlet channel having a ring-shaped cross-sectional area is formed between an outside surface of the spindle tip and an inside surface of the nozzle body.

The air spinning device in the sense of the present invention is understood to be a yarn spinning device or a roving spinning device, such that the proposed device may be used for all spinning methods that operate with air.

A spinning device that serves to produce a yarn with the help of a stream of air includes a slubbing or fiber band feed, a drawing mechanism, an air spinning device, and a winding mechanism. A fiber band is guided by the fiber band feed from an upstream fiber band storage to a drawing mechanism. In the drawing mechanism, the fiber band is drawn at a certain deformation and is sent onto the air spinning device. The drawn fiber band is sent to an eddy zone via a fiber guide element in the air spinning device. The eddy zone is a space between the fiber guide element and the inlet opening into a spindle opposite the fiber guide element. The eddy zone is arranged in a nozzle body into which the fiber guide element is inserted from the one side and a spindle is inserted from the opposite side.

In the eddy zone, compressed air is introduced through appropriately arranged boreholes, leading through the arrangement of boreholes to form an eddy which is dissipated along the spindle on the outside. Some of the fibers of the fiber band introduced into the air spinning device are separated from the fiber band by the eddy current of compressed air introduced and wrapped around the tip of the spindle. The ends of the fibers remain captured in the fibers of the fiber band that have not been separated out and are drawn into the spindle with the so-called core fibers. During the retraction of these loosened fibers, also known as winding fibers, into the spindle opening, the winding fibers are wound around the core fibers due to the eddy current.

Various properties of the spinning operation can be influenced through the design of the individual components and the settings of the eddy air. For example, the number of winding fibers may be altered in comparison with the number of core fibers or the number of windings per length or the yarn twist of the finished yarn can be adjusted. The yarn twist is understood to be the angle at which the winding fibers are wrapped around the core fibers in relation to the longitudinal axis of the yarn. It is possible in this way to produce yarns with different properties in the air spinning method, for example, even roving. Roving is understood to be an intermediate product which is used as the starting product for the final spinning methods, for example, ring spinning or rotor spinning. In the production of roving, it is important for the yarn twist, on the one hand, to be low enough that it can be loosened again in the final spinning process and, on the other hand, for it to be great enough to ensure a reliable transport and a trouble-free feed to the final spinning device.

Various types of air spinning devices are known from the state of the art. EP 2 009 150 A1 discloses an air spinning device having a nozzle body and a hollow spindle. The spindle protrudes with its spindle tip into the nozzle body. A ring-shaped outlet channel is formed between the outside surface of the tip of the spindle and the inside surface of the nozzle body. The eddy air is removed along the spindle through the outlet channel. The outlet channel has a cylindrical shape and the distance between the inside surface of the nozzle body and the outside surface of the spindle is constant. This gap width is constant over the course of the longitudinal axis of the spindle so that the cross-sectional area normal to the longitudinal axis of the spindle is constant over the course of the longitudinal axis of the spindle. Furthermore, a certain range for the dimension of the gap width and the inside diameter of the nozzle body is disclosed in EP 2 009 150 A1. Apart from the dimensions of the spindle tip and the nozzle body and thus the definition of the outlet channel, the shape of the outlet channel is crucial for the behavior of the eddy air flow. Due to the cylindrical shape of the outlet channel, the eddy air can flow unhindered along the spindle tip. Short fibers are then picked up by the flow and transported away by the air flowing out along the spindle tip. This forms a so-called discharge, which contains fibers that have not been bound into the resulting yarn due to the process and are separated out of from the spinning process.

The amount of the discharge therefore has a significant influence on the yarn production cost because it reduces the utilization of raw materials.

Another disadvantage of the air spinning device as disclosed in the related art is that the yarn twist can be influenced only by reducing the eddy air, which results in a reduction in the eddy air leading at the same time to a reduction in the number of winding fibers, while the discharge quantity usually increases because the fibers are not bound adequately.

SUMMARY

An object of the invention is to avoid the disadvantages of the state of the art and create an air spinning device, which makes it possible to minimize the discharge and thus allow better utilization of raw materials while simplifying the setting of the yarn twist. Additional objects and advantages of the invention will be set forth in part in the following description, or may be obvious from the description, or may be learned through practice of the invention.

In accordance with aspects of the invention, an air spinning device is provided with a nozzle body and a hollow spindle having a spindle tip and a longitudinal axis. The spindle tip protrudes into the nozzle body and forms an outlet channel with a ring-shaped cross-sectional area between and outside surface of the spindle tip and an inside surface of the nozzle body, and a gap width, seen normal to the longitudinal axis of the spindle, is constant over the circumference of the spindle at a certain location in the outlet channel. The outside surface of the spindle tip and/or the inside surface of the nozzle body is/are shaped in such a way that at least two constrictions are formed in the outlet channel in its course in the direction of the longitudinal axis of the spindle. The outlet channel has a ring-shaped cross-sectional area at each of these constrictions in its course in the direction of the longitudinal axis of the spindle, with the cross-sectional area being smaller than the ring-shaped cross-sectional area of the outlet channel upstream and downstream from each of these at least two constrictions.

The invention may be used with basically any air spinning machine, regardless of the type of yarn or roving to be produced, in which at least some of the fibers have a twist in the cross section of the process products, and the machine therefore has an air spinning device with a hollow spindle and a nozzle body.

In air spinning to produce a yarn or roving by winding core fibers with winding fibers, air spinning devices which encompass a hollow guide spindle and a nozzle body are used. A yarn guide channel that opens with a spindle opening in the spindle tip is provided in the spindle. A fiber band to be spun is introduced into the nozzle body through a fiber guide element upstream from the spindle. The spindle protrudes at its tip into the nozzle body, and an outlet channel with a ring-shaped cross-sectional area is formed between an outside surface of the spindle tip and an inside surface of the nozzle body. An eddy zone is formed between the fiber guide element and the spindle tip. Compressed air is injected into the eddy zone through appropriately arranged boreholes, resulting in an eddy flow due to the arrangement of boreholes. The compressed air is removed from the eddy zone through the outlet channel, resulting in a rotating stream of air guided along the spindle.

The fibers introduced into the air spinning device by the fiber guide element are divided by the eddy flow into core fibers, winding fibers, and discharge, wherein the core fibers are introduced directly into the spindle opening, the winding fibers are gripped at one end in the core fibers and are wrapped around the spindle tip at the other end, and the discharge is removed from the air spinning device by the air flow guided along the spindle. The fibers wrapped around the spindle tip move in a helical line around the spindle tip, forming a so-called fiber cluster. The area of the spindle in which the wrapped fibers move is referred to as the spindle tip. The outflow of air going beyond this area of the spindle has no direct influence on the movement of the fibers. The number of winding fibers is determined by the distance of the spindle tip from a last clamping point of the fiber band. Before reaching the fiber guide element, the fiber band is guided through a pair of rollers which forms a clamping point. Because of the length of the individual fibers, the distance between this clamping point and the tip of the spindle is selected. At a constant fiber length, the proportion of winding fibers increases with an increase in the distance between the clamping point and the spindle tip. However, at the same time, this increase in the number of winding fibers results in an increase in the discharge. By making the outlet channel narrower, the discharge can be reduced again but that has a negative effect on eddying and turbulence of the winding fibers.

According to the invention, the outlet channel is designed in its geometric shape so that fibers in the discharge are captured by the winding fibers before being removed and then they are bound into the yarn or roving. This has the advantage that the discharges are reduced without influencing the eddy effect on the winding fibers. The shape of the outlet channel changes the path of the fibers around the spindle tip. When considered over the length of the fibers, individual sections of the fibers are subject to acceleration, deceleration, or eddying in their rotating helical movement because of the design of the outlet channel. The type of movements induced by the fibers around the spindle tip also influences the yarn twist. Due to the reduction in the circumferential velocity, there is a lower twist so that the air and flow conditions in the eddy zones need not be changed for example, by reducing the eddy air.

In a first embodiment, the air spinning device comprises a novel body and a hollow spindle having a spindle tip and a longitudinal axis, wherein the spindle tip protrudes into the nozzle body and forms an outlet channel having a ring-shaped cross-sectional area between an outside surface of the spindle tip and an inside surface of the nozzle body. A gap width at a certain location in the outlet channel, as seen normal to the longitudinal axis of the spindle, is constant over the circumference of the spindle. The outside surface of the spindle tip is shaped so that at least two constrictions are formed in the outlet channel in its course in the direction of the longitudinal axis of the spindle, wherein the outlet channel has a ring-shaped cross-sectional area at each of these constrictions in its course in the direction of the longitudinal axis of the spindle, this being smaller than the ring-shaped cross-sectional area of the outlet channel upstream and downstream from each of these at least two constrictions. The inside surface of the nozzle body has a cylindrical shape, which results in the same gap width at each location of the outlet channel over the circumference and forms a ring-shaped cross section. The flow pattern of the eddy air flowing out is influenced by the constrictions created in the outlet channel. The constrictions produce a change in the eddying of the air flowing out. In particular, the velocity of the air flowing out is influenced by the constrictions. The velocity is reduced upstream from a constriction, is increased by the constriction of the outlet channel, and is reduced again by the subsequent widening of the outlet channel. By creating a breakaway edge due to the shape at the constriction, backflow or eddies rotating perpendicularly to the air flow along the spindle are created, and this additionally contributes toward a reduction in the discharge.

The formation of backflows downstream from a constriction is increased by a second following constriction. The backflow and the resulting eddies cause the fibers, which would normally be carried away as discharge along the spindle, to be pressed at least partially against the spindle. In the vicinity of the outside surface of the spindle, these fibers are captured by the fibers that are within the fiber ring and are thereby tied into the yarn. The eddies resulting from the backflow rotate about an axis that stands essentially perpendicular to the axis of the spindle and is on a concentric circle with the inside contour of the nozzle body. The eddy rotates on its own, on the one hand, and on the other hand, the eddy is rotated in a circular pattern about the spindle due to the stream of air which rotates the fiber cluster.

A constriction may be formed by providing a ring-shaped bulge on the outside surface of the spindle tip. The development of the bulge is limited in its geometric shape only by the fact that the aforementioned cross-sectional area results in a uniform gap width over the circumference of the spindle. The integrally molded bulge may be round or wavy or may also have edges. In one embodiment having a plurality of constrictions, they may be formed by multiple bulges such that the bulges can be differentiated due to different geometric shapes as well as different dimensions.

To promote the formation of the backflows and/or eddy currents normal to the spindle axis, for example, asymmetrical wave forms or bulges and/or barreling are provided with an undercut in the direction of the course of the yarn.

The spindle is preferably embodied in two parts. The spindle tip with the bulge formed on it forms a first part of the spindle and is attachable to the second part of the spindle. "Attachable" is understood to mean that the first and second parts of the spindle are coordinated to fit exactly with one another at a contact point. The parts of the spindle may be joined together at the contact point without creating a mechanical or chemical bond. Because of the pressure conditions prevailing in the nozzle body, the two parts of the spindle are held together. In addition, a mechanical connection of the first part to the second part of the spindle may also be provided, and may be a plug connection or a screw connection, for example. In another embodiment, the first part of the spindle is formed by the outside surface of the spindle tip, this being attachable to the second part of the spindle, for example, in the form of a spindle tip sleeve. The fastening may be accomplished by plug connection or by some other type of fastening, for example, by screwing. The advantage of the two-part embodiment lies in a simple replaceability of the part of the spindle that is subject to the greatest wear. In addition, there is the possibility of changing the shape of the outside surface of the spindle tip without having to replace the entire spindle. A change in the eddy zone is also possible simultaneously with the replacement of the spindle tip if the spindle tip protrudes more deeply into the nozzle body, for example, than the spindle tip replaced.

It has been found that the ratio of the largest outside diameter of the bulge to the smallest outside diameter of the spindle tip is preferably 1.05 to 1.5 for the structural embodiment of the bulge or the sum of the bulges.

In a second embodiment, the spindle tip is designed with a cylindrical shape and the inside surface of the nozzle body is shaped so that at least two constrictions are formed in the outlet channel in its course in the direction of the longitudinal axis of the spindle such that the outlet channel has a ring-shaped cross-sectional area at each of these constrictions in its course in the direction of the longitudinal axis of the spindle, this cross-sectional area being smaller than the ring-shaped cross-sectional area of the outlet channel upstream and downstream from each of these at least two constrictions. The constriction may be formed by a barreling in the nozzle body, which protrudes in a ring shape into the interior of the nozzle body. Various geometric shapes are also conceivable for the embodiment of such a barreling. The integrally molded barreling may be round or may also have edges. In an embodiment having a plurality of constrictions, they may be formed by a plurality of rolls of barreling, such that the rolls of barreling may be differentiated by different geometric shapes as well as different dimensions. The nozzle may also be embodied in two parts, such that the inside surface of the nozzle body is formed by a nozzle body insert, the latter being insertable into the nozzle body.

Due to the change in the position of the nozzle body in relation to the spindle in the direction of the longitudinal axis of the spindle, the formation and size of constrictions within the outlet channel can be adjusted. Due to the fact that the spindle or the nozzle body is movable in the direction of the longitudinal axis of the spindle, the outlet channel is adjustable in its shape along the spindle tip. The same effect is achieved by a nozzle body which is movable in the longitudinal direction of the spindle because the relative displacement of the spindle and nozzle body toward one another leads to a change in the setting. Thus, for example, with an increase in the size of the distance of the spindle with the spindle opening from the fiber guide element, an increase in the size of the eddy zone may be created. At the same time, the gap width may be reduced if bulges on the spindle tip are brought into alignment with barreling formed on the inside surface of the nozzle body. The same adjustments can be achieved by replacing a spindle tip sleeve or a nozzle body insert.

A combination of the first embodiment with the second embodiment is also conceivable. The design of the inside surface of the nozzle body and the outside surface of the spindle are, however, to be coordinated with one another, such that the cross-sectional area of the outlet channel is ring-shaped and yields in a certain cross-sectional area a gap width which is the same over the circumference of the spindle. Another embodiment can be achieved if barreling in the nozzle body does not reduce the inside diameter of the nozzle body but instead increases it. Such grooves or channels are to be understood under the term "barreling" if a constriction of the outlet channel is created in conjunction with the spindle tip.

Regardless of the embodiment of the outlet channel, the spindle tip of the inside diameter of the yarn guide channel can be altered by inserting a yarn guide insert into the yarn guide channel of the spindle tip. At the same time, the shape of the spindle opening is also variable by such a yarn guide insert. By creating constrictions in the outlet channel, a back-flow in the yarn guide channel may be formed, which results in air being drawn through the spindle into the eddy zone against the direction of yarn conveyance. The stream of air, which is drawn along the fiber guide element into the eddy zone, is diminished accordingly. The air flowing along the fiber guide element is important for the fiber band separation and for the transport of the fiber band to the spindle opening. This circumstance may be taken into account by a constriction of the yarn guide channel with the insert of the yarn guide insert in the area of the spindle tip.

BRIEF DESCRIPTION OF THE DRAWINGS

The invention is explained in greater detail below on the basis of exemplary embodiments and is illustrated by drawings.

DESCRIPTION

Figure 1:
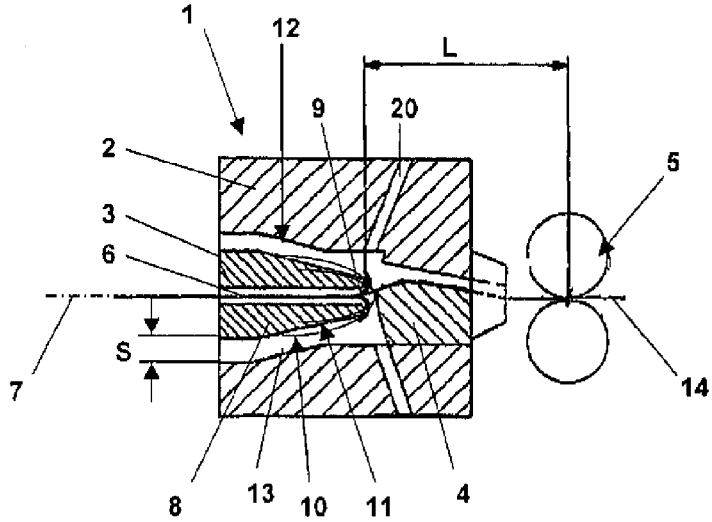
Fig. 1 PRIOR ART
FIG. 1 shows a schematic diagram of an air spinning device according to the state of the art.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic diagram of an air spinning device 1 having a nozzle body 2, a spindle 3, a fiber guide element 4 and a roll pair 5. The spindle 3 is hollow and comprises a yarn guide channel 6 which opens in a spindle opening 9 at the spindle tip 8. A fiber band 14 is fed through the roll pair 5 to the spindle opening 9 via a fiber guide element 4. Air is introduced into the nozzle body 2 in the direction of the spindle tip 8 through boreholes 20. The boreholes are created in such a way that an eddy current, which captures some of the fibers from the fiber band and wraps them around the spindle tip 8, is formed at the spindle tip 8. The air thereby introduced is removed along the spindle tip 8 via an outlet channel 13 such that the stream of air flows around the spindle tip 8. The outlet channel 13 is formed by the outside surface 11 of the spindle tip 8 and the inside surface 12 of the nozzle body 2. The outlet channel 13 has a ring-shaped cross section because of the geometry of the spindle tip 8 and the interior of the nozzle body 2. The ring-shaped cross section has a constant gap width S around the spindle tip 8 and normal to the longitudinal axis 7 of the spindle 3.

The fibers 10 wrapped around the spindle tip 8 are moved around the spindle tip 8 in a helical pattern by the rotating stream of air. The part of the spindle 3 about which the wrapped fibers 10 are rotating is referred to as the spindle tip 8. The removal of air over this area of the spindle 3 no longer has any direct influence on the movement of the fibers 10. The second end of the fibers 10 is captured in the core fibers which go directly from the fiber guide element 4 into the spindle opening 9. The wrapped fibers 10 are therefore drawn into the spindle opening 9 where they are wound around the core fibers due to the rotating stream of air. The distance L between the roll pair 5 and the spindle tip 8 and/or the spindle opening 9 has no significant effect on the number of winding fibers 10 which are formed by the eddy air.

Figure 2:
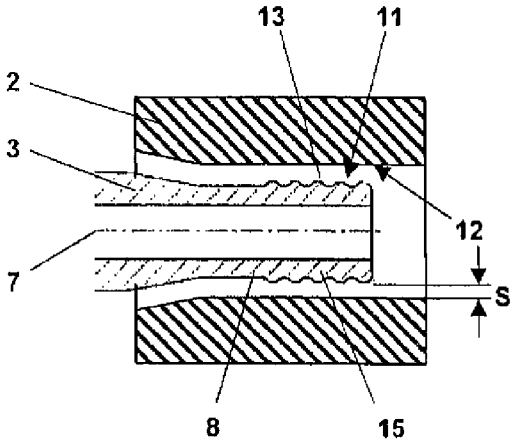
FIG. 2 shows a schematic diagram of an inventive air spinning device in a first embodiment.

FIG. 2 shows a detail of nozzle body 2 with a spindle 3 protruding into the nozzle body 2 and having a spindle tip 8. A plurality of ring-shaped bulges 15 are integrally molded on the spindle tip 8 normal to the longitudinal axis 7 of the spindle 3 and/or the spindle tip 8. The bulges 15 shown here are shown with a symmetrical round shape for example. However, angular shapes may also be selected and a symmetrical arrangement is not obligatory. The outlet channel 13 bordered by the inside surface 12 of the nozzle body 2 and the outside surface 11 of the spindle tip 8 has a ring-shaped cross section. Due to the bulges 15, the outlet channel 13 has a plurality of constrictions in its course along the longitudinal axis 7 of the spindle 3. With these constrictions, the gap width S is smaller than that before or after a bulge 15. The stream of air moving in a helical pattern in the outlet channel 13 in the direction of the longitudinal axis 7 is influenced by the constrictions.

Figure 3:
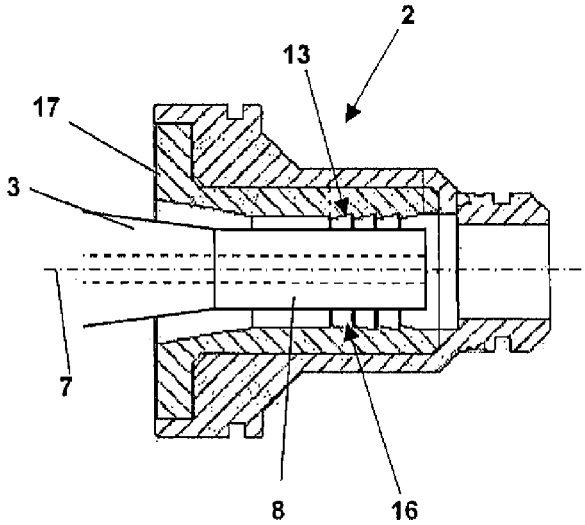
FIG. 3 shows a schematic diagram of an inventive air spinning device in a second embodiment.

FIG. 3 shows another embodiment of the air spinning device according to the invention. The nozzle body 2 is designed in two parts in contrast with FIG. 2, where in FIG. 3 the outlet channel 13 is bordered by the inside surface of a nozzle body insert 17. The use of a nozzle body insert 17 permits simple replacement of a component that is under great stress without having to replace the entire nozzle body 2. It is also possible to install various nozzle body inserts 17 in the same nozzle body 2 in alternation. In the exemplary embodiment shown here, the spindle tip 8 is embodied cylindrically with a planar surface. The inside of the nozzle body insert 17 is provided with trapezoidal barreling 16 protruding into the interior of the nozzle body insert 17 in a ring shape. Constrictions are created in the outlet channel 13 by the barreling 16. The trapezoidal shape of the barreling has the effect that the stream of air separates at the edge protruding into the outlet channel 13 and eddies whose axis of rotation is approximately normal to the longitudinal axis 7 of the spindle 3 are formed.

Figure 4:
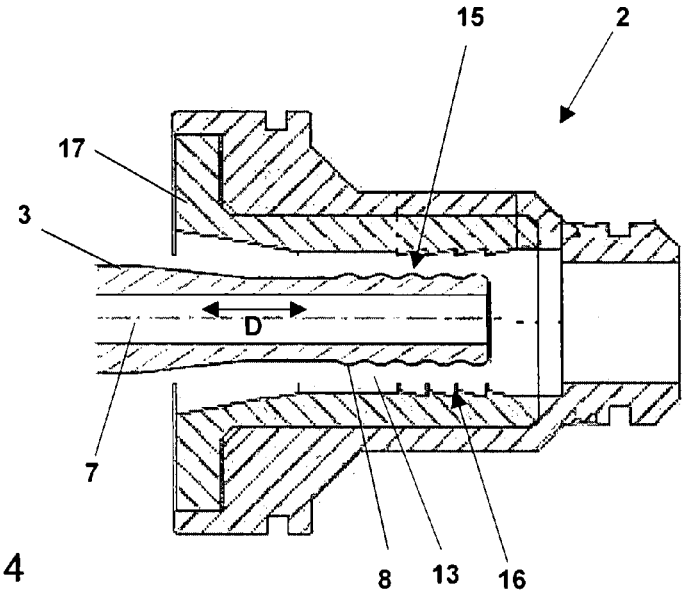
FIG. 4 shows a schematic diagram of an inventive air spinning device in a third embodiment.

FIG. 4 shows a combination of the embodiments of FIGS. 2 and 3. Constrictions are formed in the outlet channel 13 by ring-shaped barreling 16 in the nozzle body insert 17 and by ring-shaped bulges 15 on the spindle tip. The bulges 15 and the barreling 16 need not be applied to the same location in the course of the longitudinal axis 7 of the spindle 3. In addition, the spindle 3 is arranged in its holder so that it is displaceable with respect to the nozzle body 2. The spindle 3 may be shifted in the direction D of the longitudinal axis 7 of the spindle. The adjustment of the position of the spindle tip 8 within the nozzle body insert 17 permits a variation in the relationships in the outlet channel 13 that influence the stream of air along the spindle tip 8. The discharge behavior of the air spinning device can be adapted to the properties and composition of the fiber bands to be spun by varying the flow conditions in the outlet channel without having to replace the spindle tip 8 or the nozzle body insert 17.

Figure 5:
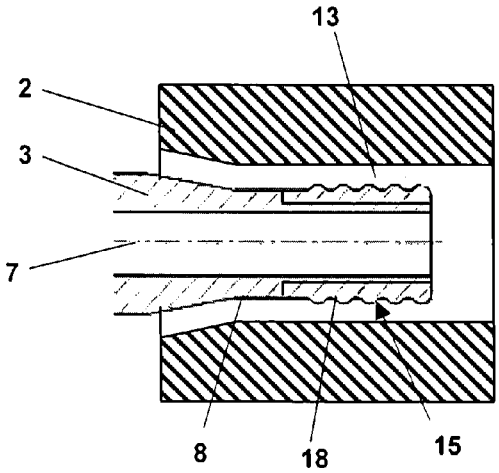
FIG. 5 shows a schematic diagram of a two-part spindle tip.

FIG. 5 shows the embodiment of FIG. 2 with a two-part spindle 3. A spindle tip sleeve 18 is applied over the spindle tip 8. The bulges 15, which create the constrictions in the outlet channel, are not applied directly to the spindle tip 8 in the two-part embodiment of the spindle 3 shown here, but instead are applied to the outside surface of a spindle tip sleeve 18. The spindle tip sleeve 18 is easily replaceable as a disposable part. However, in replacement of the spindle tip sleeve 18, there is also the possibility of selecting a spindle tip sleeve 18 that implements a different embodiment of the ring-shaped bulges 15 on its outside. In the embodiment shown here, the spindle tip sleeve has been attached to the spindle tip 8. No further connection between the spindle tip 8 and the spindle tip sleeve 18 is necessary because of the stream of air in the outlet channel. However, the spindle tip sleeve may also be attached to the spindle tip 8 by other fastening methods, for example, by a screw connection, a pressing method or a gluing method, a form-fitting connection, a snap connection or by magnetic forces.

Figure 6:
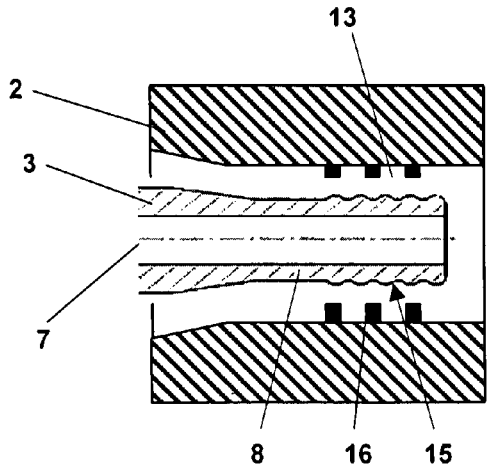
FIG. 6 shows a schematic diagram of an inventive air spinning device in a fourth embodiment.

FIG. 6 also shows the embodiment of FIG. 2, wherein barreling 16 has been additionally created on the inside 12 of the nozzle body. The barreling 16 protruding into the interior of the nozzle body 2 is designed in the form of rings with a rectangular cross section. The cooperation of the barreling 16 with the bulges 15 provided on the spindle tip 8 forms an outlet channel 13 in the form of a labyrinth. FIG. 6 also shows that the constrictions in the outlet channel 13 created by bulges 15 and barreling 16 may have a small extent in the direction of the longitudinal axis 7 of the spindle 3 in relation to the length of the spindle tip 8. The installed rings are shown schematically, and a design of technically favorable embodiments of bulges 15 and barreling 16 is implemented by the skilled person and is not taken into account in the diagram.

Figure 7:
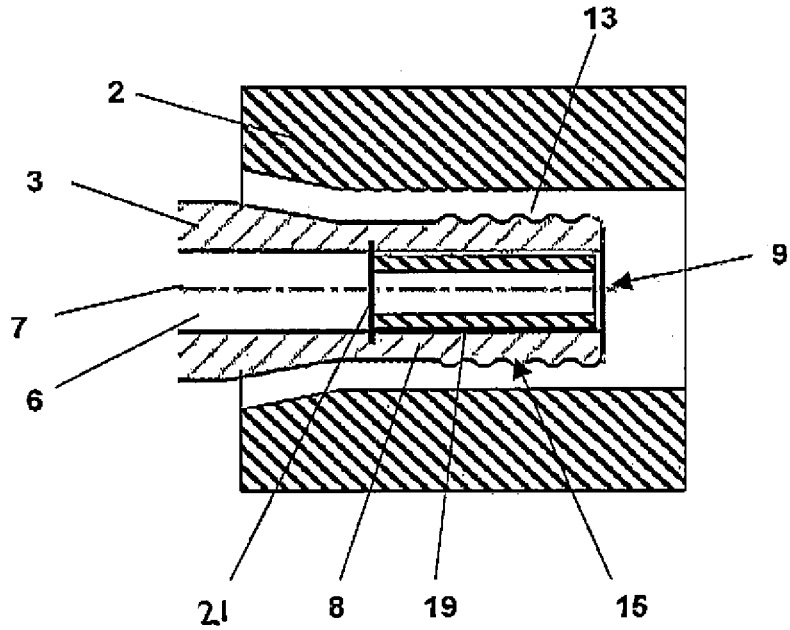
FIG. 7 shows a schematic diagram of a two-part spindle.

FIG. 7 also shows the embodiment of FIG. 2, wherein a yarn feed insert 19 is additionally shown. The inside diameter of a spindle 3 and/or the dimensions of the yarn guide channel 6 of a spindle 3 depend on various factors, for example, on the properties and the composition of the fiber material to be spun or the desired yarn quality or the twist of the yarn to be produced. Due to the change in the shape of the outlet channel 13 and thus the stream of air of the eddy air flowing out of the eddy zone, another variable which influences the dimensions of the yarn guide channel 6 has been added. Since the design of the outlet channel 13 can additionally be influenced by the use of spindle tip sleeves, nozzle body inserts, or the change in the position of the spindle tip 8 in the nozzle body, a simple setting of the dimensions of the yarn guide channel 6 is advantageous. Such a setting option is possible through the use of yarn guide inserts 19. A yarn guide insert 19 is inserted through the spindle opening into the yarn guide channel 6 of the spindle 3. The positioning of the yarn guide insert 19 in the yarn guide channel 6 may be accomplished by a simple stop 21. Such a stop 21 may be integrally molded on the spindle 3, for example, or may be formed by a Seeger ring inserted.

Figure 8:
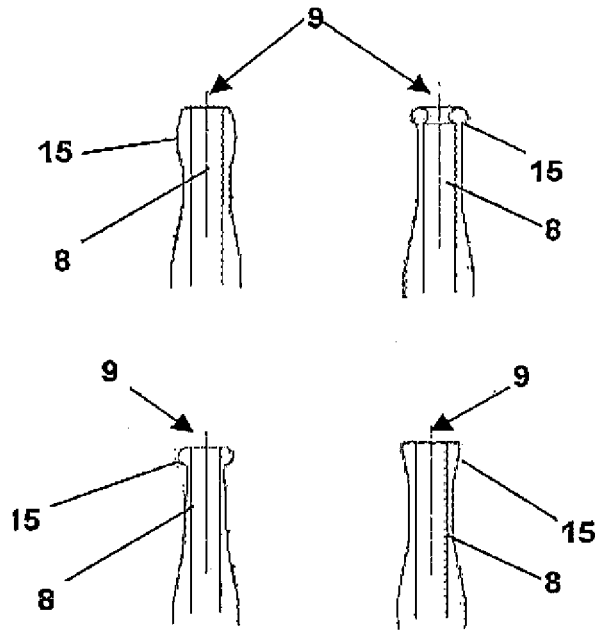
FIG. 8 shows a schematic diagram of various embodiment of a spindle.

FIG. 8 shows various exemplary embodiments of a design of the spindle tip 8 according to the invention. The four spindle tips 8 shown here can be combined in any desired way with the designs of the inside surfaces of the nozzle bodies and/or nozzle body inserts shown in FIGS. 2 through 6 to form an outlet channel. The four spindle tips 8 shown here have a variety of ring-shaped bulges 15 integrally molded onto them. The bulges 15 may also be formed by spindle tip sleeves according to the FIG. 5 however. In the examples shown here, a bulge 15 is arranged near the spindle opening 9 in each case, and it should be noted that the outside diameter of the spindle tip directly at the site of the spindle opening 9 is smaller than at the location of the largest extent of the ring-shaped bulge 15. Therefore, a constriction in the air spinning device is not formed directly at the spindle opening 9.

FIG. 9 shows a schematic diagram of various exemplary forms of barreling and/or bulges on the inside surfaces of the nozzle bodies or the outside surfaces of the spindle tips. The direction of travel of the yarn is indicated with the arrow 23 in each of FIGS. 9A through 9D.

Figure 9A:
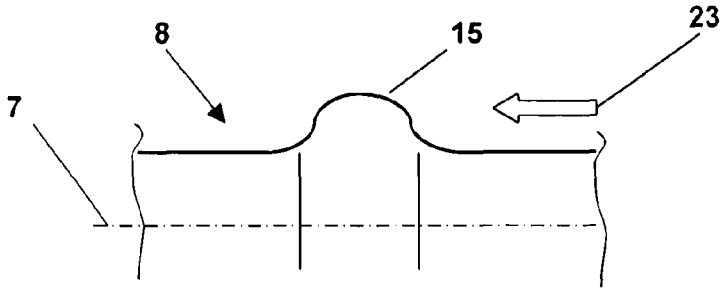
FIG. 9 shows a schematic diagram of various exemplary forms of bulges and/or rolls on nozzle bodies or spindles.
Figure 9B:
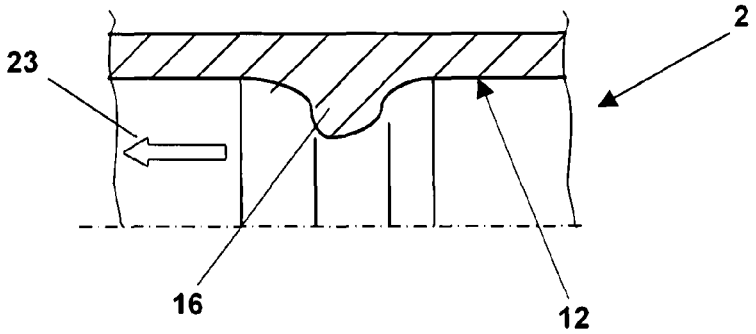
Figure 9C:
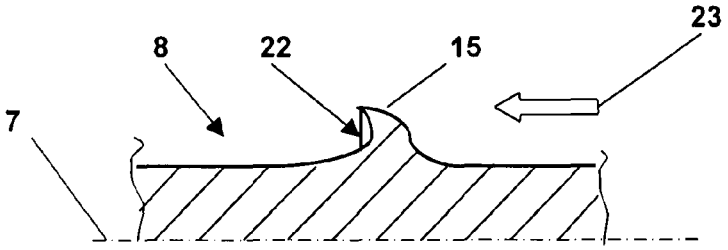

FIGS. 9A and 9C show details of the spindle tips 8. FIG. 9A shows a spindle tip 8 with a longitudinal axis 7 and an integrally molded bulge 15. The bulge 15 is designed with a wave-type symmetrical shape. In this case in the symmetrical embodiment, the direction of travel of the yarn 23 does not play a role. In FIG. 9C, however, a bulge 15 with an undercut 22 is shown. In this case the direction of travel of the yarn 23 is important because the intended backflow does not occur to the desired extent with the eddy formation in oncoming flow against the bulge from the wrong side.

Figure 9D:
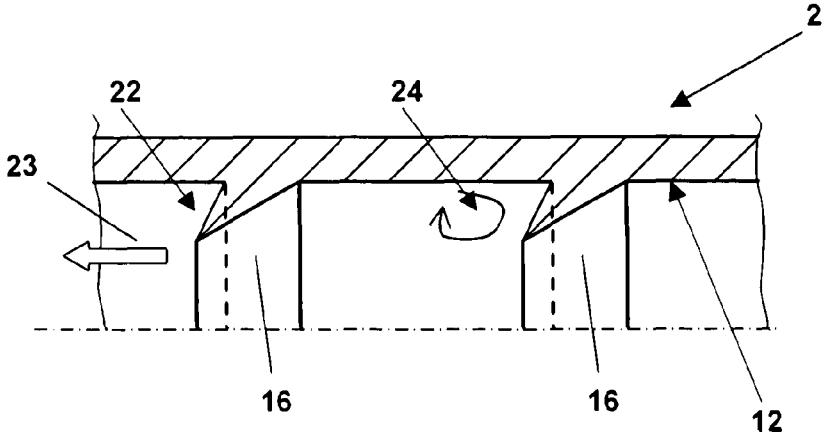

FIGS. 9B and 9D show details of the nozzle body 2 in a sectional diagram so that the inside surface 12 of the nozzle body 2 can be seen. FIG. 9B shows a nozzle body 2 with asymmetrical barreling 16. The barreling 16 is designed to first increase obliquely in the direction of yarn travel 23 and then to drop steeply. Such an arrangement promotes the development of a backflow to support the binding of short fibers into the resulting yarn in the spindle tip. FIG. 9D shows a nozzle body 2 with two successive rolls of angular barreling 16. The two rolls of barreling 16 shown in FIG. 9D are designed the same, although this is not obligatory. The undercut 22 facilitates the development of the backflow 24 and a resulting eddy. Due to the backflow 24, short fibers in the discharge, which are conveyed over the barreling 16, are moved in the direction of the middle of the nozzle body 2 and away from the inside surface 12 of the nozzle body 2. The spindle tip together with the rotating fiber cluster is situated at the center of the nozzle body 2 as described above.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

The invention claimed is:

1. An air spinning device, comprising:

a nozzle body;

a hollow spindle having a spindle tip and defining a longitudinal axis, said spindle tip protruding into said nozzle body;

an outlet channel having a ring-shaped cross-sectional area between an outer surface of said spindle tip and an inside surface of said nozzle body;

at least two constrictions defined in said outlet channel along the direction of said longitudinal axis; and wherein said ring-shaped cross-sectional area of said outlet channel is smaller at said constrictions as compared to said ring-shaped cross-sectional area of said outlet channel upstream and downstream of said constrictions.

2. The air spinning device as in claim 1, wherein said constrictions are formed on either or both of said outer surface of said spindle tip or said inside surface of said nozzle body.

3. The air spinning device as in claim 1, wherein at least one of said constrictions is defined by a ring-shaped bulge on said outer surface of said spindle tip.

4. The air spinning device as in claim 1, wherein at least one of said constrictions is defined by a ring-shaped barreling on said inside surface of said nozzle body.

5. The air spinning device as in claim 1, wherein said spindle is formed of a first part that is attachable to a second part.

6. The air spinning device as in claim 5, wherein said outer surface of said spindle tip is defined by a sleeve that is attachable to said spindle tip, said sleeve comprising at least one ring-shaped bulge that defines at least one of said constrictions.

7. The air spinning device as in claim 1, wherein said nozzle body is formed in two parts, wherein one of said parts is an insert that fits into the other said part, said insert defining said inside surface of said nozzle body, said insert comprising at least one ring-shaped barreling that defines at least one of said constrictions.

8. The air spinning device as in claim 1, wherein one of said spindle or said nozzle body is movable along said longitudinal axis such that said outlet channel is adjustable in shape along said spindle tip.

9. A spindle for use in an air spinning device, comprising a spindle body having a spindle tip at an end thereof;

a yarn guide channel defined through said spindle body, said yarn guide channel having a spindle opening in said spindle tip;

at least one ring-shaped bulge formed on said spindle tip, said ring shaped bulge defining an air flow constriction within an outlet channel formed between an outer surface of said spindle tip and an inside surface of a nozzle body when said spindle is inserted into the nozzle body of the air spinning device.

10. The spindle as in claim 9, wherein a ratio of a largest outside diameter of said bulge to a smallest outside diameter of said spindle tip is about 1.05 to 1.5.

11. The spindle as in claim 9, wherein said spindle is formed in two fitted-together parts, with a first one of said parts defining said spindle tip.

12. The spindle as in claim 9, wherein said spindle is formed in two fitted-together parts, with a first one of said parts comprising a sleeve that is attachable to said spindle tip, said sleeve comprising at least one ring-shaped bulge that defines an air flow constrictions in the outlet channel when said spindle is inserted into the nozzle body of the air spinning device.

13. The spindle as in claim 9, further comprising a yarn guide insert that is insertable into said spindle tip and defines said yarn guide channel and said spindle opening.

14. A method for producing a yarn or roving by winding core fibers with winding fibers in an air spinning device, wherein the air spinning device includes a hollow spindle having a spindle tip and a spindle opening, a nozzle body, and an outlet channel having a ring-shaped cross-sectional area between an outside surface to the spindle tip and an inside surface of the nozzle body, comprising:

introducing fibers into the air spinning device via a fiber guide element and dividing the fibers with an eddy current produced in the nozzle body into core fibers introduced directly into the spindle opening, winding fibers that are captured at one end in the core fibers and are wrapped around the spindle tip at the other end, and discharge fibers that are removed by air flow along the spindle;

forming at least two air flow constrictions within the outlet channel that cause the discharge fibers to be captured by the winding fibers and introduced into the yarn or roving before being discharged, wherein the number of discharge fibers is reduced by the air flow constrictions; and wherein the constrictions are formed with a ring-shaped cross-sectional area that is smaller than the ring-shaped cross-sectional area of the outlet channel on upstream and downstream sides of the constrictions.

15. The method as in claim 14, wherein air flow through the outlet channel is influenced by the constrictions such that eddy currents are formed in the outlet channel in a direction normal to air flow along the spindle.

* * * * *